US007556013B2

(12) United States Patent
Negoro et al.

(10) Patent No.: US 7,556,013 B2
(45) Date of Patent: Jul. 7, 2009

(54) COVER STRUCTURE FOR A COOLING SYSTEM COMPONENT OF AN INTERNAL COMBUSTION ENGINE, AND ENGINE INCORPORATING SAME

(75) Inventors: Masaaki Negoro, Wako (JP); Reina Kurosu, Wako (JP); Nobutaka Wakita, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 137 days.

(21) Appl. No.: 11/895,064

(22) Filed: Aug. 23, 2007

(65) Prior Publication Data

US 2008/0047503 A1 Feb. 28, 2008

(30) Foreign Application Priority Data

Aug. 28, 2006 (JP) ..... 2006-230952

(51) Int. Cl.
*F02B 77/00* (2006.01)

(52) U.S. Cl. ..... 123/195 C

(58) Field of Classification Search ..... 123/41.31, 123/195 C, 197.1, 197.5, 198 E, 198 P
See application file for complete search history.

(56) References Cited

U.S. PATENT DOCUMENTS 6,941,920 B1 * 9/2005 Thurm et al. ..... 123/195 C
7,318,405 B2 * 1/2008 Tanaka et al. ..... 123/195 C

FOREIGN PATENT DOCUMENTS

JP 07-55291 12/1995

* cited by examiner

*Primary Examiner*—Hai H Huynh
(74) *Attorney, Agent, or Firm*—Carrier, Blackman & Associates, P.C.; William D. Blackman; Joseph P. Carrier

(57) ABSTRACT

A cover structure for an internal combustion engine covers and protects a coolant pipe of a cooling system component on an internal combustion engine, even when the internal combustion engine only has a short distance provided between a crankshaft and an output shaft. The cover structure includes an outer cover disposed outside an inner cover, thereby defining a space between the first and outer covers. Coolant conduits, which are in fluid communication with a cooling system component, are constructed and arranged to pass through the space between the first and outer covers.

9 Claims, 6 Drawing Sheets

COVER STRUCTURE FOR A COOLING SYSTEM COMPONENT OF AN INTERNAL COMBUSTION ENGINE, AND ENGINE INCORPORATING SAME

CROSS-REFERENCE TO RELATED APPLICATIONS

The present invention claims priority under 35 USC § 119 based on Japanese patent application No. 2006-230952, filed on Aug. 28, 2006. The subject matter of this priority document is incorporated by reference herein.

BACKGROUND OF THE INVENTION

1. Technical Field of the Invention

The present invention relates to a cover structure of an internal combustion engine. More particularly, the present invention relates to a cover structure for a coolant pipe of a cooling device of an internal combustion engine, which is mounted on a motorcycle.

2. Background Art

In the field of cover structures for internal combustion engines, there is known a cover structure in which a water pump and a protective cover, which covers and protects a coolant pipe in communication with a cooling system of the internal combustion engine, are integrally mounted on a sprocket wheel cover, which covers a drive sprocket wheel connected to an output shaft of the internal combustion engine, for example, in Japanese patent document JP-UM-B-7-55291.

Further, in order to decrease the size of an internal combustion engine, there is known an internal combustion engine in which a distance between a crankshaft and an output shaft is shortened. In such an internal combustion engine, a drive sprocket wheel, which is connected to the output shaft, and a coolant pipe of a cooling device are overlapped in the width direction of the vehicle. However, with such an internal combustion engine, it is difficult to cover and protect the coolant pipe using the protective cover described above in patent document 1.

The present invention has been made in view of the above situation, and an object of the present invention is to provide a cover for an internal combustion engine which can cover and protect a coolant pipe of a cooling device of an internal combustion engine even when the internal combustion engine is an internal combustion engine which has a short distance between a crankshaft and an output shaft.

SUMMARY OF THE INVENTION

To achieve the above-mentioned object, according to a first aspect of the invention, a cover structure of an internal combustion engine is provided, which includes: an inner cover arranged to cover a portion of a drive force transmission mechanism, which is connected to an output shaft of an internal combustion engine, and a cooling device for cooling the internal combustion engine; an outer cover arranged outside the inner cover; and a coolant pipe of the cooling device which passes through a space defined between the inner cover and the outer cover.

In a second aspect of the invention, the throttle management apparatus for an internal combustion engine according to the first aspect of the invention is further characterized in that the outer cover is mounted on the internal combustion engine by insertion and fitting the outer cover into fitting openings formed in the inner cover and the internal combustion engine.

In a third aspect of the invention, the throttle management apparatus for an internal combustion engine according to the first aspect of the invention is further characterized in that a lower portion of the outer cover is provided with a guide portion which guides a hose having one end portion thereof exposed to the outside air and an opening which is communicated with the guide portion.

According to the first aspect of the invention, the outer cover is arranged outside the inner cover, and the coolant pipe of the cooling device passes through the space defined between the inner cover and the outer cover. Therefore, even when the internal combustion engine is an internal combustion engine which has a short distance between a crankshaft and an output shaft, it is possible to cover and protect the coolant pipe of the cooling device of the internal combustion engine. Further, the coolant pipe is protectively covered by the outer cover, thereby enhancing the appearance of the internal combustion engine. Still further, the radiation sounds from the internal combustion engine can be reduced due to the first and outer covers thereby enhancing the tranquility of the internal combustion engine.

According to the second aspect of the invention, it is possible to mount the outer cover on the internal combustion engine by inserting and fitting the outer cover into fitting openings formed in the inner cover and the internal combustion engine, thereby easing the assembly of the outer cover.

According to the third aspect of the present invention, the lower portion of the outer cover is provided with a guide portion, for supportively guiding a hose having an end portion exposed to the environment outside the cover, and an opening which is in communication with the guide portion. With such an arrangement, it is unnecessary to additionally fix the hose using a clamp or the like, thus reducing the number of parts required.

DETAILED DESCRIPTION

A selected illustrative embodiment of the invention will now be described in some detail, with reference to the drawings. Note that, in the following, the drawings are viewed in the same direction as numerals. It should be understood that only structures considered necessary for clarifying the present invention are described herein. Other conventional structures, and those of ancillary and auxiliary components of the system, are assumed to be known and understood by those skilled in the art.

Figure 1:
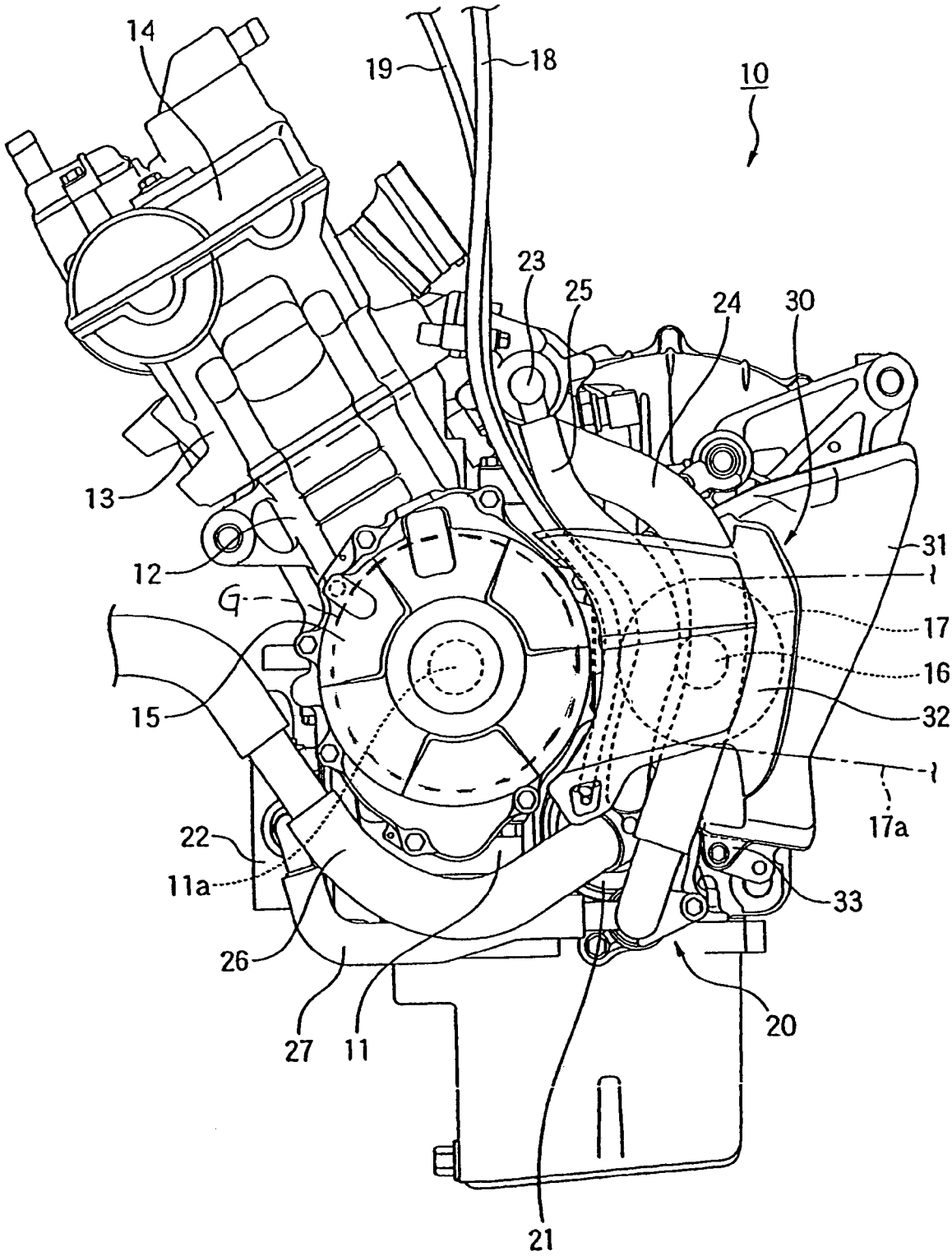
FIG. 1 is a side view of an internal combustion engine incorporating a cover structure according to a selected illustrative embodiment of the present invention.

First, as shown in FIG. 1, an internal combustion engine 10 includes a crankcase 11 which incorporates a transmission (not shown), a cylinder block 12 which is integrally formed on an upper front portion of the crankcase 11, a cylinder head 13 which is fixed to an upper end portion of the cylinder block 12, and a cylinder head cover 14 which closes an opening formed in an upper end portion of the cylinder head 13. The engine 10 also includes a generator G operatively attached to the crankcase 11, a generator cover 15 which closes an opening formed in a left-side surface of the crankcase 11, a cooling device 20 for cooling the internal combustion engine 10, and a crankshaft 11*a*. The generator G is operated in a known manner via rotation of the crankshaft 11*a*.

On the left-side surface of the crankcase 11, an output shaft 16 of the transmission (not shown) is mounted so as to projecting from the crankcase 11, and a drive sprocket wheel 17, which is part of the drive force transmission mechanism, is connected to the output shaft 16. Further, a drive chain 17*a*, which is also part of the drive force transmission mechanism, is wound around the drive sprocket wheel 17.

The cooling device 20 includes: a water pump 21 arranged below the drive sprocket wheel 17 of the crankcase 11, an oil cooler 22 arranged on a front end surface of the crankcase 11, a thermostat valve 23 arranged on an upper end portion of the crankcase 11, a water jacket (not shown) formed in the inside of the cylinder block 12 and the cylinder head 13, and a radiator (not shown) arranged in front of the internal combustion engine 10. The water pump 21, the oil cooler 22, the thermostat valve 23, the water jacket (not shown), and the radiator (not shown) are in communication with each other by way of respective coolant pipes 24, 25, 26, 27. The coolant pipes 24, 25, 26 and 27 may be made from rubber, reinforced elastomeric tubing, or similar material.

In the internal combustion engine 10 of the depicted embodiment, the water pump 21 of the cooling device 20 is arranged below the drive sprocket wheel 17, thereby shortening the distance between the crankshaft 11*a* and the output shaft 16 as compared to a conventional internal combustion engine.

Figure 2:
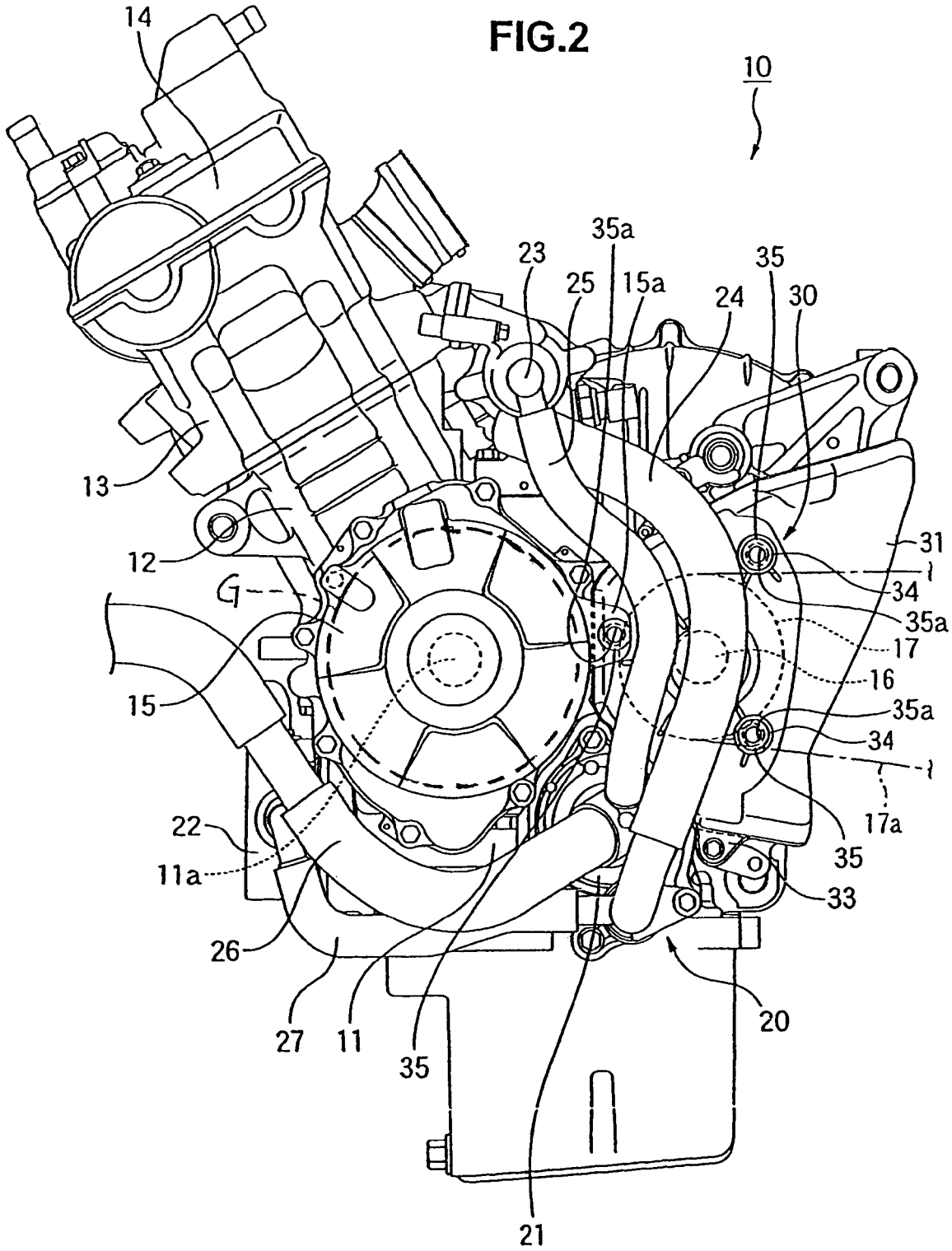
FIG. 2 is a side view of the internal combustion engine of FIG. 1, with an outer cover removed from the internal combustion engine.

Further, in the depicted embodiment, as shown in FIG. 1 and FIG. 2, the coolant pipes 24, 25 of the cooling device 20 are protectively covered by a cover structure 30. The cover structure 30 includes a sprocket wheel cover 31 fixed to a left-side surface of the crankcase 11. The sprocket wheel cover 31 is also referred to as an inner cover 31 herein, and is arranged to cover the drive sprocket wheel 17. The cover structure 30 also includes a coolant pipe cover 32, which is also referred to herein as an outer cover 32. The outer cover 32 is mounted on the outer surfaces of the inner cover 31 and the generator cover 15, and which is arranged outside the inner cover 31.

The outer cover 32 and the inner cover 31 cooperate to define a predetermined distance therebetween. This predetermined distance between the inner cover 31 and the outer cover 32 allows for the coolant pipes 24, 25 of the cooling device 20 to vertically pass through the space defined between the inner cover 31 and the outer cover 32. By passing the coolant pipes 24, 25 through the space defined by the inner cover 31 and the outer cover 32, the coolant pipes 24, 25 are protectively covered by the outer cover 32.

Figure 3:
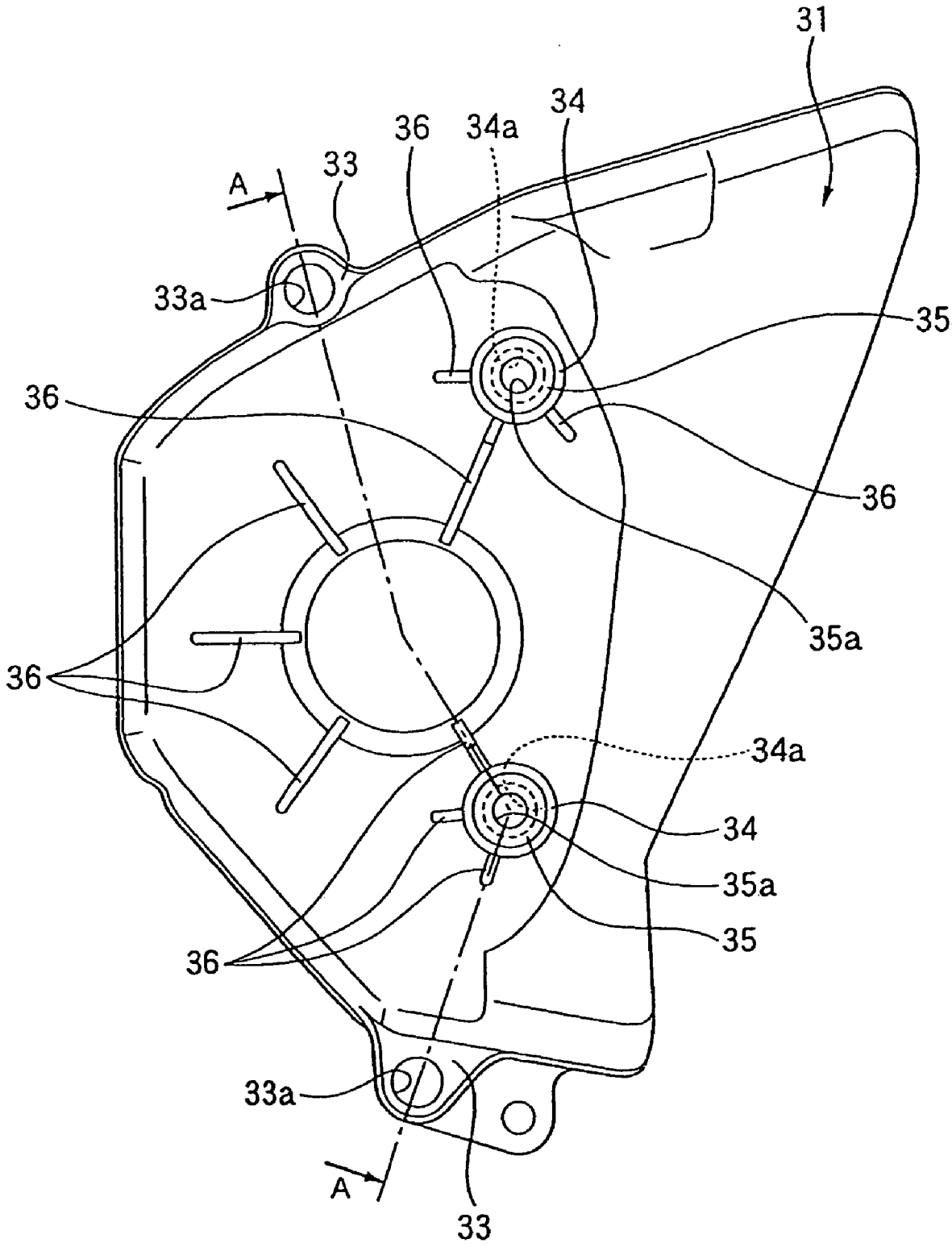
FIG. 3 is a side view of an inner cover which is a component of the engine of FIG. 2.
Figure 4:
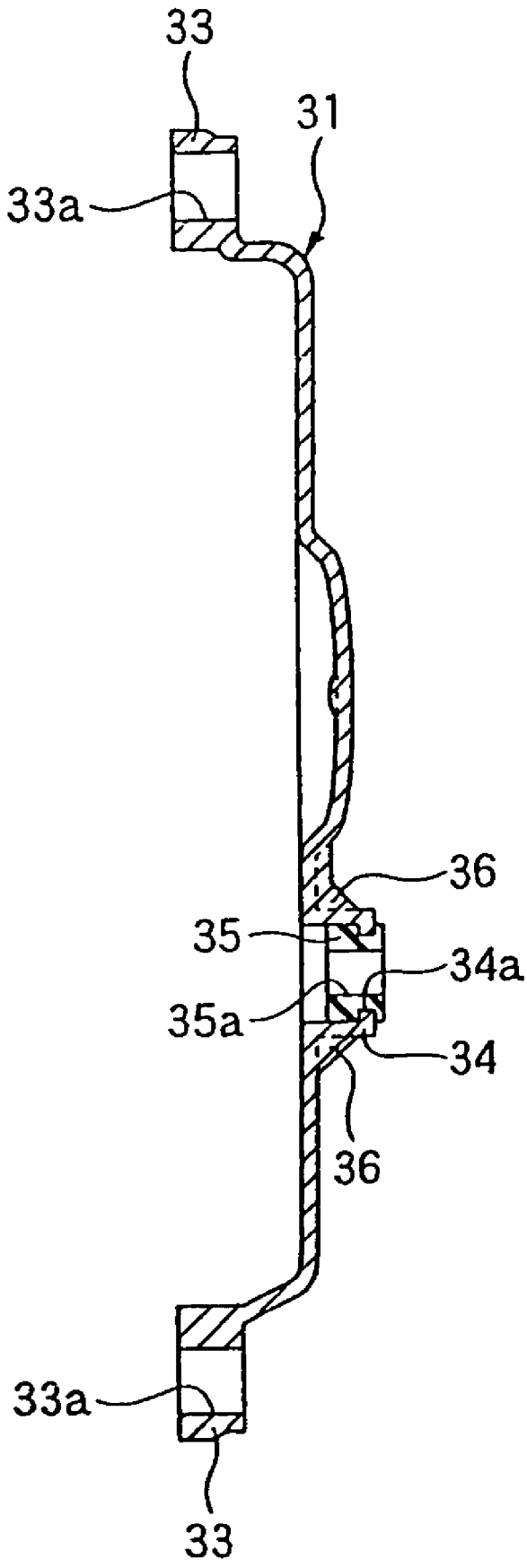
FIG. 4 is a cross-sectional view of the inner cover, taken along a line indicated by an arrow A-A in FIG. 3.

As shown in FIG. 3 and FIG. 4, the inner cover 31 is formed as a generally plate-shaped member having a modified substantially trapezoidal shape, as viewed from a side view. A pair of fixing members 33, each having a respective bolt insertion hole 33*a* formed therein, are integrally cast on upper and lower edge portions, respectively, of the inner cover 31. The inner cover 31 is fixed to the crankcase 11 by fastening the fixing members 33, 33 to the left-side surface of the crankcase 11 using fasteners, for example bolts (see FIG. 2).

Two fitting projections 34 are formed on an outer surface of the inner cover 31. Mounting holes 34*a* are formed in outer end surfaces of the fitting projections 34. Rubber or elastomeric grommets 35, having fitting holes 35*a* therein to receive projections 37 of the outer cover 32 (described below), are inserted into the fitting projections 34. Reinforcing ribs 36 are also cast in to the inner cover 31, to increase the strength and rigidity thereof.

As shown in FIG. 2, a plate-like mounting stay 15*a* is formed on a rear portion of the generator cover 15, and the mounting stay 15*a* has a mounting hole formed therein. A rubber or elastomeric grommet 35, having a fitting hole 35*a* therein, is inserted into the mounting hole of the mounting stay 15*a*, and is provided to engagingly receive a projection 37 of the coolant pipe 32 (described later).

Figure 5:
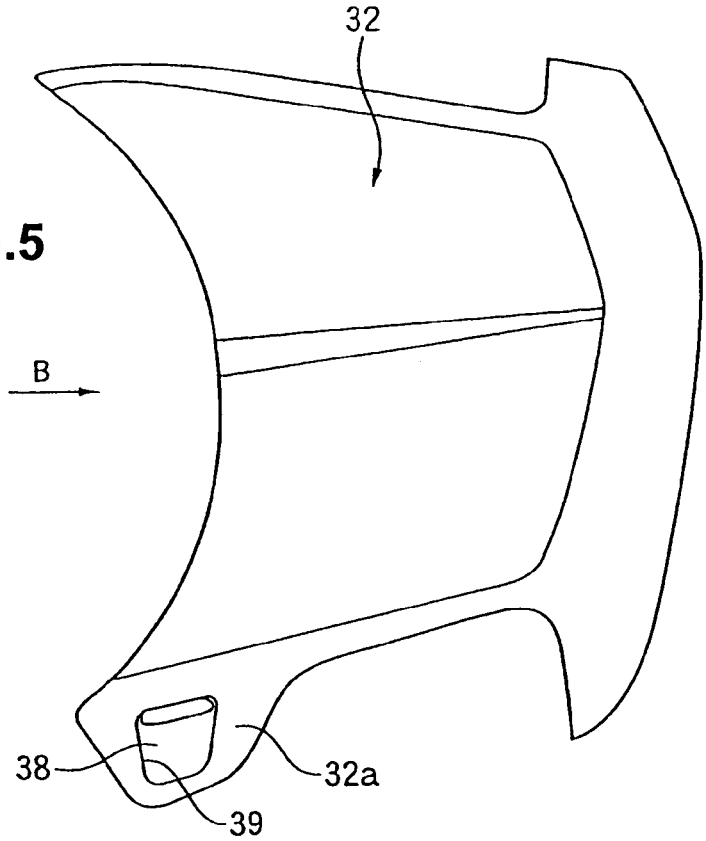
FIG. 5 is a side view of an outer cover which is a component of the engine of FIG. 1.
Figure 6:
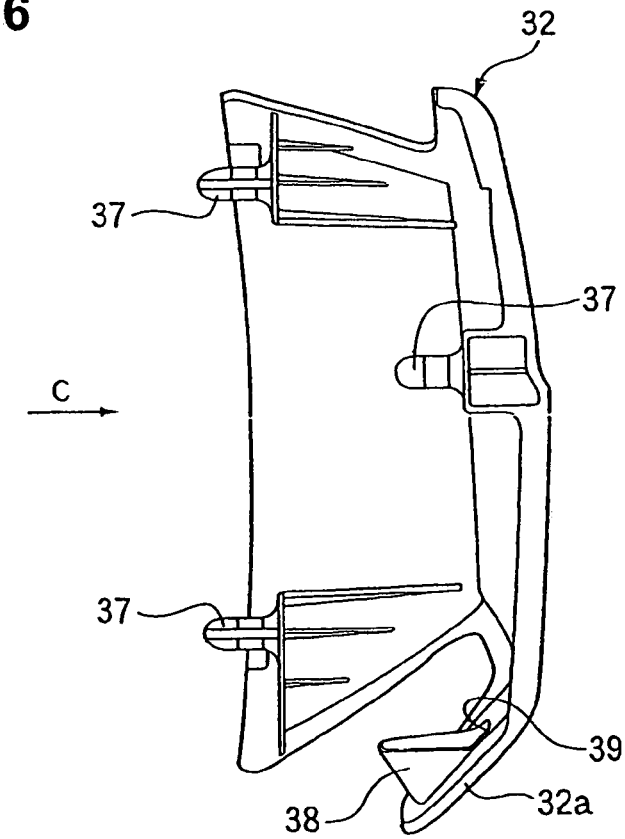
FIG. 6 is an end view of the outer cover, from a vantage point indicated by the arrow B in FIG. 5.
Figure 7:
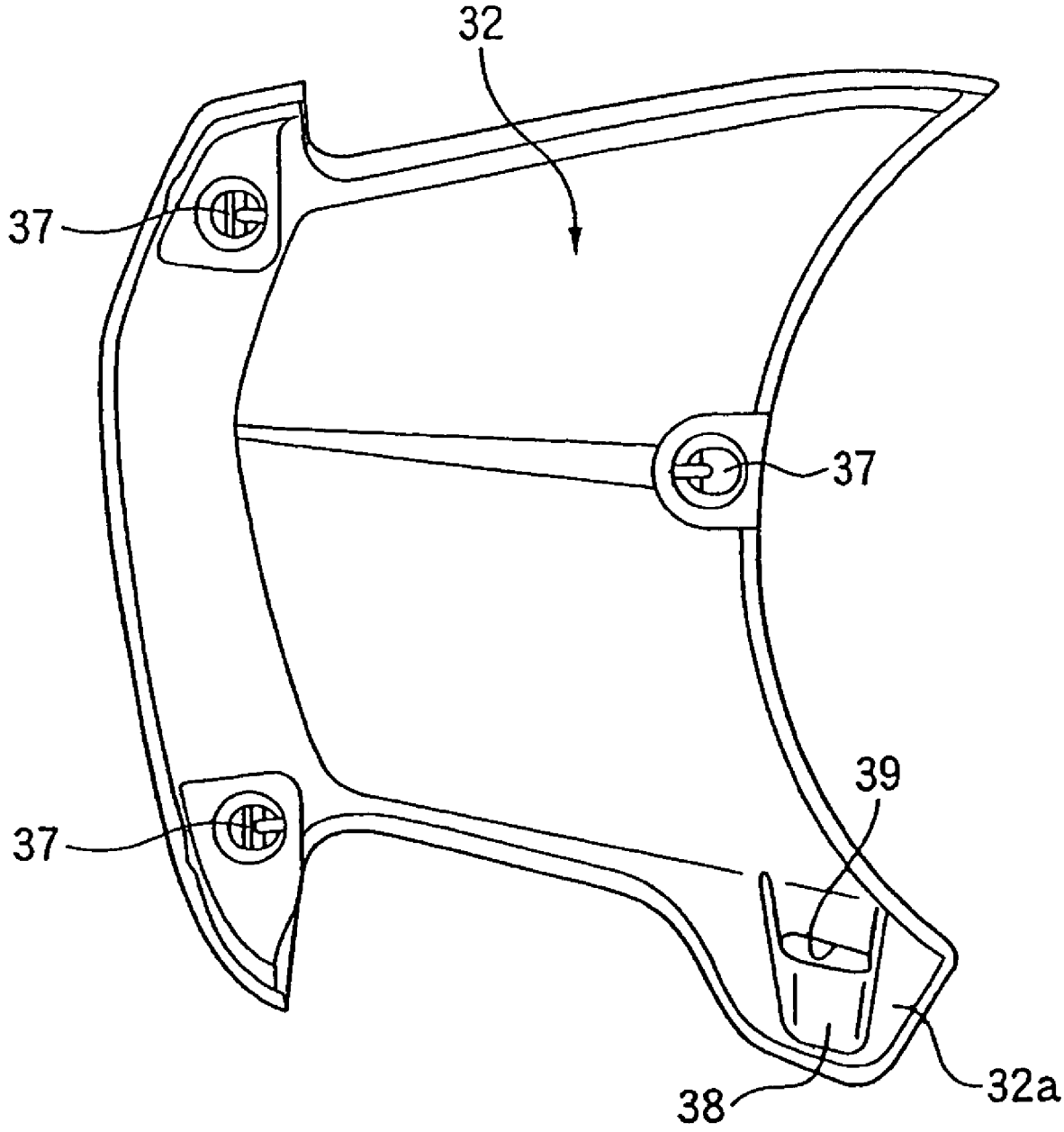
FIG. 7 is another side view of the outer cover, from a vantage point indicated by the arrow C in FIG. 6, and opposite to the vantage point of FIG. 5.

As shown in FIG. 5 to FIG. 7, the outer cover 32 is formed as a generally plate-shaped member having a substantially trapezoidal shape as viewed from a side view, and the projections 37 (which are inserted into the fitting holes 35*a*) are formed on an inner surface of the outer cover 32, at positions corresponding to the fitting holes 35*a* formed in the grommets 35 of the inner cover 31 and the generator cover 15. The outer cover 32 is mounted on the inner cover 31 and the generator cover 15 by respectively inserting and fitting the projections 37 into the fitting holes 35*a* formed in the grommets 35 of the inner cover 31 and the generator cover 15. The outer cover 32 is formed into an approximately L-shape, when viewed in a plan view, for forming a space defined between the inner cover 31 and the outer cover 32. The space defined between the inner cover 31 and the coolant pipe cover allows the coolant pipes 24, 25 to pass through the defined space. A front edge of the outer cover 32 is formed into an arcuate shape along an outer peripheral surface of the generator cover 15.

On a lower end portion of the outer cover 32, an inclined portion 32*a* is inwardly and downwardly inclined is formed. The inclined portion 32*a* is provided with a guide portion 38, which guides a large-diameter breather hose 18 (a hose having one end portion thereof exposed to the outside air) and a small-diameter breather hose 19 (a hose having one end thereof exposed to the outside air), and an opening 39. The opening 29 is in communication with the guide portion 38. The guide portion 38 arranges the large-diameter breather hose 18 above the opening 39 and arranges the small-diameter hose 19 below the opening 39 in parallel (see FIG. 1). Examples of different uses for the breather hoses 18, 19 include a breather hose which discharges a blowby gas inside of the internal combustion engine 10, a breather hose which discharges fuel vapor inside of a fuel tank (not shown in the drawing), and a breather hose in a reserve tank of the cooling device 20.

In the cover structure 30 of the internal combustion engine 10 having the above-mentioned formation, by inserting the projections 37 of the outer cover 32 into the fitting holes 35*a* formed in the grommets 35 of the inner cover 31 and the generator cover 15, the outer cover 32 is mounted on the inner cover 31 and the generator cover 15, and is arranged outside the inner cover 31. Accordingly, a space is formed between the inner cover 31 and the outer cover 32. By allowing the coolant pipes 24, 25 to pass through the space, the coolant pipes 24, 25 are protectively covered by the outer cover 32. Further, the rubber or elastomeric grommets 35 are arranged between the inner cover 31 and the outer cover 32 and between the generator cover 15 and the outer cover 32 and hence, vibrations of the respective covers 15, 31, 32 can be reduced.

As explained above, according to the cover structure 30 of the internal combustion engine 10 of the depicted embodiment, the outer cover 32 is arranged outside the inner cover 31, and the coolant pipes 24, 25 of the cooling device 20 are made to pass through the space defined between the inner cover 31 and the outer cover 32. According to such an arrangement, even when the internal combustion engine 10 is an internal combustion engine in which the distance between the crankshaft 11*a* and the output shaft 16 is shortened, it is possible to cover and protect the coolant pipes 24, 25 of the cooling device 20 of the internal combustion engine 10. Further, the coolant pipes 24, 25 are protectively covered by the coolant pipe cover, thereby enhancing the appearance of the internal combustion engine 10. Still further, by using two different covers, e.g. the outer cover 32 and the inner cover 31, it is possible to reduce radiation sounds of the internal combustion engine 10 thereby enhancing the tranquility of the internal combustion engine 10. Moreover, by arranging the coolant pipes 24, 25 outside of the drive sprocket wheel 17, the radiation sounds of the internal combustion engine 10 can be further reduced.

Further, according to the cover structure 30 of the internal combustion engine 10 of the depicted embodiment, the outer cover 32 is mounted on the inner cover 31 and the internal combustion engine 10 by inserting the outer cover 32 into the fitting holes 35*a* formed in the inner cover 31 thereby making it easier to assemble the cover structure 30. Additionally, since the outer cover 32 is mounted on the inner cover 31 such that the outer cover 32 is astride to the inner cover 31, the cooling pipe cover 32 is more firmly mounted on the inner cover 31. Also, by the depicted embodiment, a load which is applied to the inner cover 31 can be reduced thereby reducing the weight of the inner cover 31 while ensuring the rigidity of the inner cover 31.

According to the cover structure 30 of the internal combustion engine 10 of the depicted embodiment, the lower end portion of the outer cover 32 is provided with the guide portion 38, which guides the hoses 18, 19, each having one end portion exposed to the outside air, and the opening 39, which is in communication with the guide portion 38, it is unnecessary to additionally fix the hoses 18, 19 using a clamp or the like thereby reducing the number of parts. Further, the opening 39 is formed in the inclined portion 32*a* of the outer cover 32 and thereby making the opening 39 inconspicuous from the outside. Still further, the guide portion 38 allows the large-diameter hose 18 to be arranged above the opening 39 and the small-diameter hose 19 to be arranged below the opening 39 thereby preventing the small-diameter hose 19 from being exposed to the outside when viewed in a side view and enhancing appearance of the internal combustion engine 10.

While a working example of the present invention has been described above, the present invention is not limited to the working example described above, but various design alterations may be carried out without departing from the present invention as set forth in the claims.

What is claimed is:

1. A cover structure for an internal combustion engine, said cover structure comprising:

an inner cover which is arranged to cover a portion of a transmission mechanism connected to an output shaft of an internal combustion engine, and a cooling system component for helping cool a portion of the internal combustion engine, an outer cover arranged outside the inner cover, said inner and outer covers cooperating to define a space therebetween, and a coolant conduit in fluid communication with said cooling system component, wherein said coolant conduit passes through the space defined between the inner and outer covers.

2. A cover structure for an internal combustion engine according to claim 1, wherein the inner cover has a plurality of fitting openings formed therein, wherein the outer cover has a plurality of engaging projections formed thereon, and wherein the outer cover is mounted on the internal combustion engine by fitting the engaging projections of the outer cover into the fitting openings of the inner cover and at least one fitting opening formed in another component of the internal combustion engine.

3. The cover structure of claim 2, wherein the inner cover further comprises a flexibly resilient grommet installed in each of the fitting projections, the grommet having a hole formed therein, and wherein the respective engaging projections fit engagingly into the holes of the respective grommets.

4. A cover structure for an internal combustion engine according to claim 1, wherein a lower portion of the outer cover is provided with a guide portion which guides a hose having one end portion thereof exposed to the outside air and wherein the guide cover has an opening formed therein which communicates with the guide portion.

5. An internal combustion engine, comprising:

a crankcase;

a water pump operatively attached to the crankcase for circulating coolant through a coolant flow path in the engine;

a generator operatively attached to the crankcase;

a generator cover operatively attached to the crankcase or to the generator, an inner cover operatively attached to the crankcase and which is arranged to cover the water pump, an outer cover arranged outside the inner cover, said inner and outer covers cooperating to define a space therebetween, and a coolant conduit in fluid communication with said water pump, wherein said coolant conduit passes through the space defined between the inner and outer covers.

6. The internal combustion engine according to claim 5, wherein the inner cover has a plurality of fitting openings formed therein, wherein the outer cover has a plurality of engaging projections formed thereon, and wherein the outer cover is mounted on the inner cover by fitting selected engaging projections of the outer cover into the fitting openings of the inner cover.

7. The internal combustion engine of claim 6, wherein the inner cover further comprises a flexibly resilient grommet installed in each of the fitting projections thereof, the grommet having a hole formed therein, and wherein selected engaging projections of the outer cover fit engagingly into the holes of the respective grommets.

8. The internal combustion engine of claim 7, wherein the generator cover has a plate-like mounting stay extending laterally outwardly thereon and having an opening fitting formed therein, wherein the opening fitting of the generator cover's mounting stay also has a flexibly resilient grommet installed therein, and wherein one of the engaging projections of the outer cover fits engagingly into the grommet in the fitting opening in the mounting stay of the generator cover.

9. The internal combustion engine according to claim 5, wherein a lower portion of the outer cover is provided with a guide portion which guides a hose having one end portion thereof exposed to the outside air, and wherein the guide cover has an opening formed therein which communicates with the guide portion.

* * * * *